US007355613B2

(12) United States Patent
Wiens

(10) Patent No.: US 7,355,613 B2
(45) Date of Patent: Apr. 8, 2008

(54) THERMAL RECORDING SYSTEM EMPLOYING ADJUSTABLE HEAD PRESSURE

(75) Inventor: Curt A. Wiens, Oakdale, MN (US)

(73) Assignee: Carestream Health, Inc., Rochester, NY (US)

( * ) Notice: Subject to any disclaimer, the term of this patent is extended or adjusted under 35 U.S.C. 154(b) by 141 days.

(21) Appl. No.: 11/196,181

(22) Filed: Aug. 3, 2005

(65) Prior Publication Data

US 2007/0030329 A1 Feb. 8, 2007

(51) Int. Cl.
*B41J 2/32* (2006.01)

(52) U.S. Cl. ..... 347/171

(58) Field of Classification Search ..... 347/198, 347/197, 171; 400/120.16, 120.17
See application file for complete search history.

(56) References Cited

U.S. PATENT DOCUMENTS 4,962,392 A 10/1990 Okuno et al.
5,176,458 A 1/1993 Wirth
5,519,428 A 5/1996 Van Peteghem
5,520,471 A 5/1996 Leys et al.
5,528,277 A 6/1996 Nardone et al.
5,547,293 A * 8/1996 Koch et al. ..... 400/120.17
5,735,617 A 4/1998 Wirth
5,806,996 A 9/1998 Leys et al.
6,788,326 B2 * 9/2004 Sasaki ..... 347/198
2003/0146968 A1 * 8/2003 Milton ..... 347/197

* cited by examiner

*Primary Examiner*—K. Feggins

(57) ABSTRACT

An imaging apparatus (30) for thermally recording images on an imaging media (44) including a printhead (32) having an array of individually energizeable heating elements (42), a rotatable drum (34) for conveying imaging media (44) past the array of heating elements (42), and an anchor element (36) moveable within a range of positions. A biasing mechanism (38) is positioned between printhead (32) and anchor element (36) and is configured to provide a biasing force to hold at least a portion of the array of heating elements (42) against rotatable drum (34), wherein a magnitude of the biasing force is based on the position of anchor element (36). An actuator system (40) is configured to adjust the position of the anchor element (36) within the range of positions so as to adjust the magnitude of the biasing force over a range of values.

17 Claims, 8 Drawing Sheets

THERMAL RECORDING SYSTEM EMPLOYING ADJUSTABLE HEAD PRESSURE

FIELD OF THE INVENTION

The present invention relates generally to an apparatus and method for thermally recording an image on a recording media, and more specifically to an apparatus and method for adjusting pressure of a recording head against the recording media.

BACKGROUND OF THE INVENTION

Thermal imaging, or thermography, is a recording process wherein images are generated by the use of image-wise modulated thermal energy. There are two commonly known methods for thermal imaging. The first is generally referred to as thermal dye transfer printing, and the second is referred to as direct thermal printing. With thermal dye transfer printing, a desired image is obtained by image-wise heating of a donor element having a dye layer, wherein the application of heat causes at least a portion of the dye to be transferred from the donor element to the imaging media. With direct thermal printing, a desired image is obtained by direct image-wise heating of a thermosensitive recording or imaging media, wherein the application of heat, by chemical or physical processes, changes the color or optical density of the imaging media.

With either method, the image-wise heating is typically accomplished through use of a thermal recording head or printhead. Thermal printheads typically comprise a number of microscopic heating elements, generally resistors, which are usually spaced in a line-wise fashion across the printhead. Typically, a rotatable drum is driven (e.g. by a dc stepper motor, for example) to advance the imaging media past the heating elements of the printhead. When printing a desired image, the thermal printhead prints one line of pixels of the image at a time, with each resistor producing one pixel of the line of pixels on the imaging media. The rotatable drum advances the imaging media as the individual lines of pixels are printed such that the desired image is constructed from a large number of individually printed lines of pixels.

To ensure proper heat transfer from the heating elements to the recording media, the thermal printhead is typically biased toward the rotatable drum, such as with a spring, so that the heating elements firmly contact the imaging media. Generally, the heating elements must be held against the imaging media with at least a certain minimum head pressure in order to achieve a desired image quality. Since the heating elements substantially form a line contact with the imaging media, the head pressure is generally defined as a biasing force of the printhead against the imaging media per unit width of the imaging media.

Some thermal imagers record images on imaging media of various widths. To ensure that the desired contact is attained between the thermal elements and the recording media, conventional thermal imagers often maintain a biasing force on the printhead against the imaging media so that at least the minimum head pressure is achieved for the widest width of imaging media. However, when printing to a narrower width of imaging media, the biasing force necessary to maintain the minimum head pressure on the wider width of media creates a head pressure against the narrower width media that is greater than the minimum head pressure. For example, a thermal imager may record images on 10-inch and 14-inch wide imaging media. If a desired head pressure of 1 kilogram-force per inch (1 kg-f/in.) is desired for a thermal printer recording images on 14-inch wide media, the thermal printhead must be held against the imaging media with a biasing force of 14 kg-f. This same 14 kg-f biasing force creates a head pressure of 1.4 kg-f/in. when a 10-inch wide imaging media is employed.

Although most types of thermal printheads include a protective coating over the heating elements, the increased head pressure against narrower media widths can lead to uneven wearing of the protective coating, with the areas of the printhead corresponding to the narrower media wearing more than those areas corresponding only to wider widths of media. Such uneven wearing can result in uneven heat transfer characteristics across the width of the printhead which, in turn, often translates to uneven densities in a printed image. For example, when printing an image on a wider width of imaging media, the thermal elements from areas of the printhead corresponding to narrower widths of media may produce densities different from those produced by thermal elements from areas of the printhead corresponding to only wider widths of media. The increased head pressure can also result in uneven wearing of the surface of the rotatable drum, which may further increase the likelihood of uneven temperature from the thermal elements to the imaging media.

In light of the above, it is evident that there is a need for improving thermal imaging systems, particularly those used to print images on multiple widths of imaging media, to reduce problems associated with varying head pressure.

SUMMARY OF THE INVENTION

In one embodiment, the present invention provides an imaging apparatus for thermally recording images on an imaging media. The imaging device includes a printhead having an array of individually energizeable heating elements, a rotatable drum for conveying the imaging media past the array of heating elements, and an anchor element moveable within a range of positions. A biasing mechanism is positioned between the printhead and the anchor element and is configured to provide a biasing force to hold at least a portion of the array of heating elements against the rotatable drum, wherein a magnitude of the biasing force is based on the position of anchor element. An actuator system is configured to adjust the position of the anchor element within the range of positions so as to adjust the magnitude of the biasing force over a range of values.

In one embodiment, the actuator system adjusts the position of the anchor element based on one or more parameters of the imaging media. In one embodiment, the imaging apparatus records images on a plurality of widths of imaging media and the actuator system is configured to adjust the position of the anchor element so as to maintain a substantially same head pressure for all widths of the plurality of widths of imaging media, wherein head pressure is defined as a ratio of the biasing force to the width of the imaging media.

In one embodiment, the present invention provides a thermal printer configured to print to multiple widths of imaging media, the thermal printer including a printhead, a rotatable drum for conveying the imaging media past the printhead, and an anchor element moveable within a range of positions. A spring is positioned between the printhead and the anchor element and configured to provide a biasing force to bias the printhead toward the rotatable drum, wherein the biasing force is based on the position of the anchor element. An actuator system is configured to adjust the position of the anchor element based on the width of the imaging media so as to adjust the biasing force.

In one embodiment, the actuator system adjusts the position of the anchor element so as to maintain a ratio of the biasing force to the width of the media substantially at a desired value, the ratio also being defined as the head pressure.

By adjusting the position of anchor element relative to rotatable drum based on the width of the sheet of imaging media so as to adjust the biasing force to maintain the head pressure substantially at a desired value, a thermal printer according to the present invention substantially reduces wearing of the thermal printhead and rotatable drum associated with printing to varying widths of imaging media. As such, a thermal printer in accordance with the present invention substantially reduces the occurrence of uneven heat transfer from the thermal elements to the imaging media resulting from printing to varying widths of imaging media, thereby increasing the quality of printed images and increasing the expected life of the drum and the thermal printhead.

DETAILED DESCRIPTION OF THE INVENTION

Figure 1:
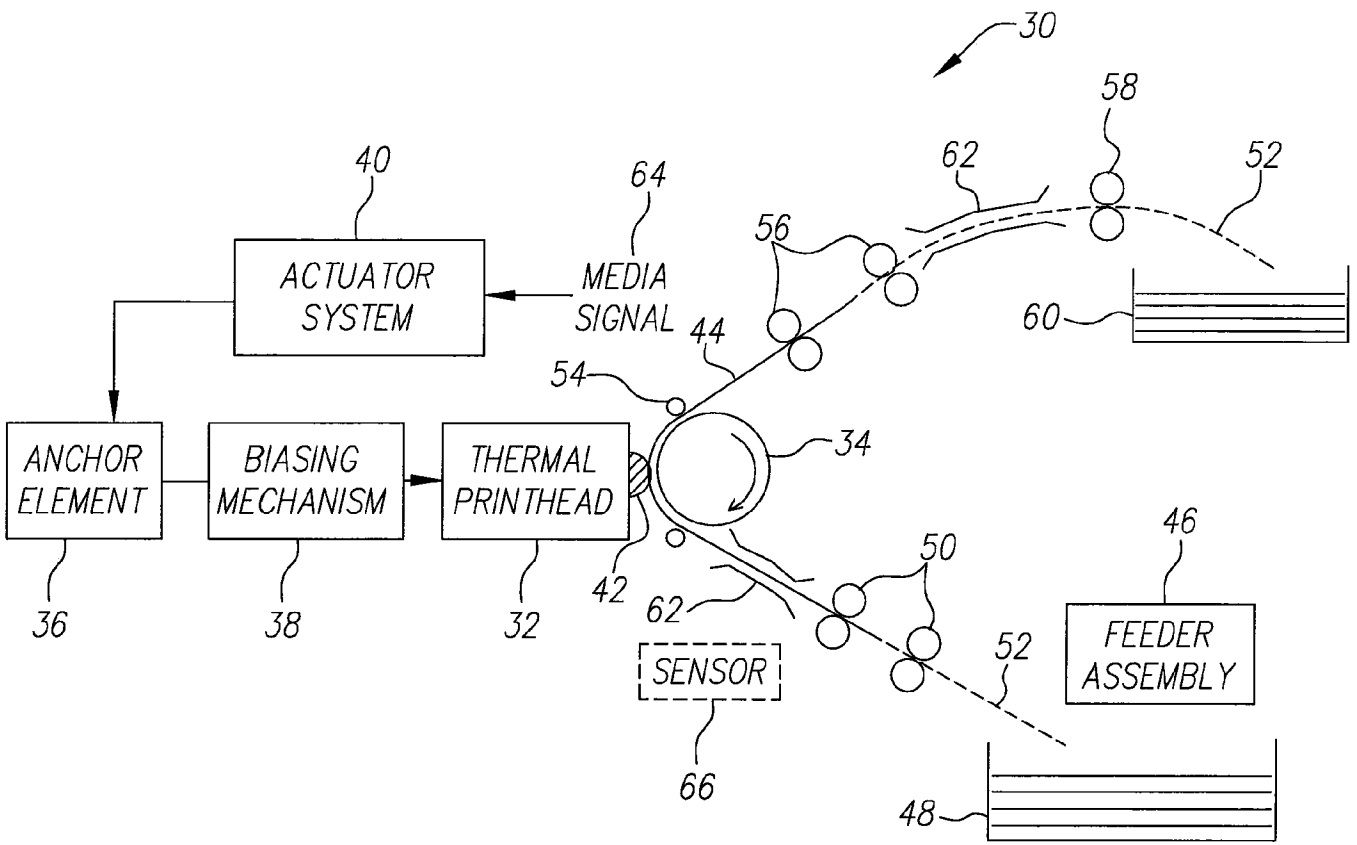
FIG. 1 is a block diagram illustrating generally one exemplary embodiment of a direct thermal printer according to the present invention.

FIG. 1 is a block diagram illustrating generally one embodiment of direct thermal printer 30 employing varying thermal printhead pressure according to the present invention. Thermal printer 30 includes a thermal printhead 32, a rotatable drum 34, an anchor element 36, a biasing mechanism 38, and an actuator system 40, with thermal printhead 32 including a linear array of individually energizeable heating elements 42 disposed across a width of thermal printhead 32.

Thermal printer 30 is configured to thermal record images on varying widths of imaging media, such as a sheet of imaging media 44 (illustrated by the heavy solid line). A feeder assembly 46 is configured to remove the top sheet of imaging media from a stack of stack of sheets of imaging media located in a removable cassette 48, and to provide the sheet of imaging media to roller pairs 50 which feed the imaging to rotatable drum 34 along a transport path 52 (illustrated by the dashed lines). Rotatable drum 34 is rotatably driven by a driving means (not shown) to convey the sheet of imaging media 44 past the array of thermal elements 42 for recording of a desired thermal image, with peripheral rollers 54 controlling the position of imaging media 44 on rotatable drum 34.

After passing thermal printhead 32, additional roller pairs 56 transport the printed sheet of imaging media 44 along transport path 52 until a final pair of rollers 58 deliver the printed sheet to an output tray 60. Media guides 62 assist in guiding sheets of imaging media along transport path 52. Transport path 52 is included for illustrative purposes, and may comprise any number of configurations and be formed by various combinations of roller pairs 50, 56, 58, peripheral rollers 54, and media guides 62.

Biasing mechanism 38 is positioned between thermal printhead 32 and anchor element 36. Biasing mechanism 38 is configured to bias thermal printhead 32 toward rotatable drum 34 and to provide a biasing force to hold at least the portion of the array of thermal elements 42 corresponding to the width of the sheet of imaging media 44 in contact with the sheet of imaging media 44, wherein the biasing force is based on a position of anchor element 36 relative to rotatable drum 34. The biasing force creates a head pressure between the array of thermal elements 42 and the sheet of imaging media 44 so as to ensure proper heat transfer from the array of thermal elements 42 to the sheet of imaging media 44, with the head pressure being defined as the ratio of the biasing force.to the width of the sheet of imaging media 44.

Actuator system 40 is configured to engage and adjust the position of anchor element 36 relative to rotatable drum 34 to adjust the biasing force so as to maintain the head pressure (i.e. the ratio of the biasing force to the width of the sheet of imaging media) substantially at a desired value. For example, in one embodiment (and as will be described in greater detail below), actuator system 40 moves anchor element 36 to a position further away from rotatable drum 30 so as to decrease the biasing force provided by biasing mechanism 38 when thermal printer 30 is printing to a narrower width of imaging media as compared to when printing to a wider width of imaging media. In one embodiment, actuator system 40 is configured to adjust the position of anchor element 36 relative to rotatable drum 34 so as to maintain the head pressure at a substantially desired level of 1 kg-f/in. when printing to all widths of imaging media.

By adjusting the position of anchor element 36 relative to rotatable drum 34 based on the width of the sheet of imaging media 44 so as to adjust the biasing force to maintain the head pressure substantially at a desired value, thermal printer 30 according to the present invention substantially reduces wearing of the thermal printhead and rotatable drum associated with printing to varying widths of imaging media. As such, a thermal printer in accordance with the present invention substantially reduces the occurrence of uneven heat transfer from the thermal elements to the imaging media resulting from printing to varying widths of imaging media, thereby increasing the quality of printed images and increasing the expected life of the drum and the thermal printhead.

In one embodiment, actuator system 40 receives a media signal 64 indicative of the width of the sheet of imaging media 44 and adjusts the position of anchor element 36 relative to rotatable drum 34 based on the media width. In one embodiment, biasing mechanism 38 provides the biasing force in a direction generally tangential to rotatable drum 34 along a line of contact with the array of thermal elements 42. In one embodiment, actuator system 40 adjusts the position of anchor element 36 along the generally tangential direction.

In one embodiment, actuator system 40 includes a sensor 66 configured to determine the width of the sheet of imaging media 44 and to provide media signal 64. In one embodiment, sensor 66 comprises a photosensor. In one embodiment, sensor 66 comprises a reader configured to read parameters associated with sheets of imaging media contained in cassette 48 from indicating means on cassette 48 and/or on the sheets of imaging media. In one embodiment, sensor 66 includes a bar code scanner to read processing parameters affixed to either the individual sheets of film or to the film cartridge in the form of a bar code. In one embodiment, sensor 66 includes a radio frequency (RF) receiver/transmitter configured to read processing parameter affixed to either the individual sheets of film or to the film cartridge in the form of an RF tag device.

Although illustrated and described in FIG. 1 with respect to a direct thermal printer, the teachings of the present invention can be readily extended to other types of thermal imaging apparatuses, such as a thermal printer employing thermal dye transfer techniques, for example. Furthermore, although adjustment of head pressure as described above is based on the width of the imaging media, the teachings of the present invention can be extended to adjust head pressure based on other parameters associated with the imaging media. For example, the head pressure may be adjusted based on a thickness of the imaging media or on the type of media. For example, a type of imaging media employed for a thermal dye transfer process may require a different head pressure for optimal print quality or transport characteristics than a type of imaging media employed for a direct thermal printing process.

Figure 2:
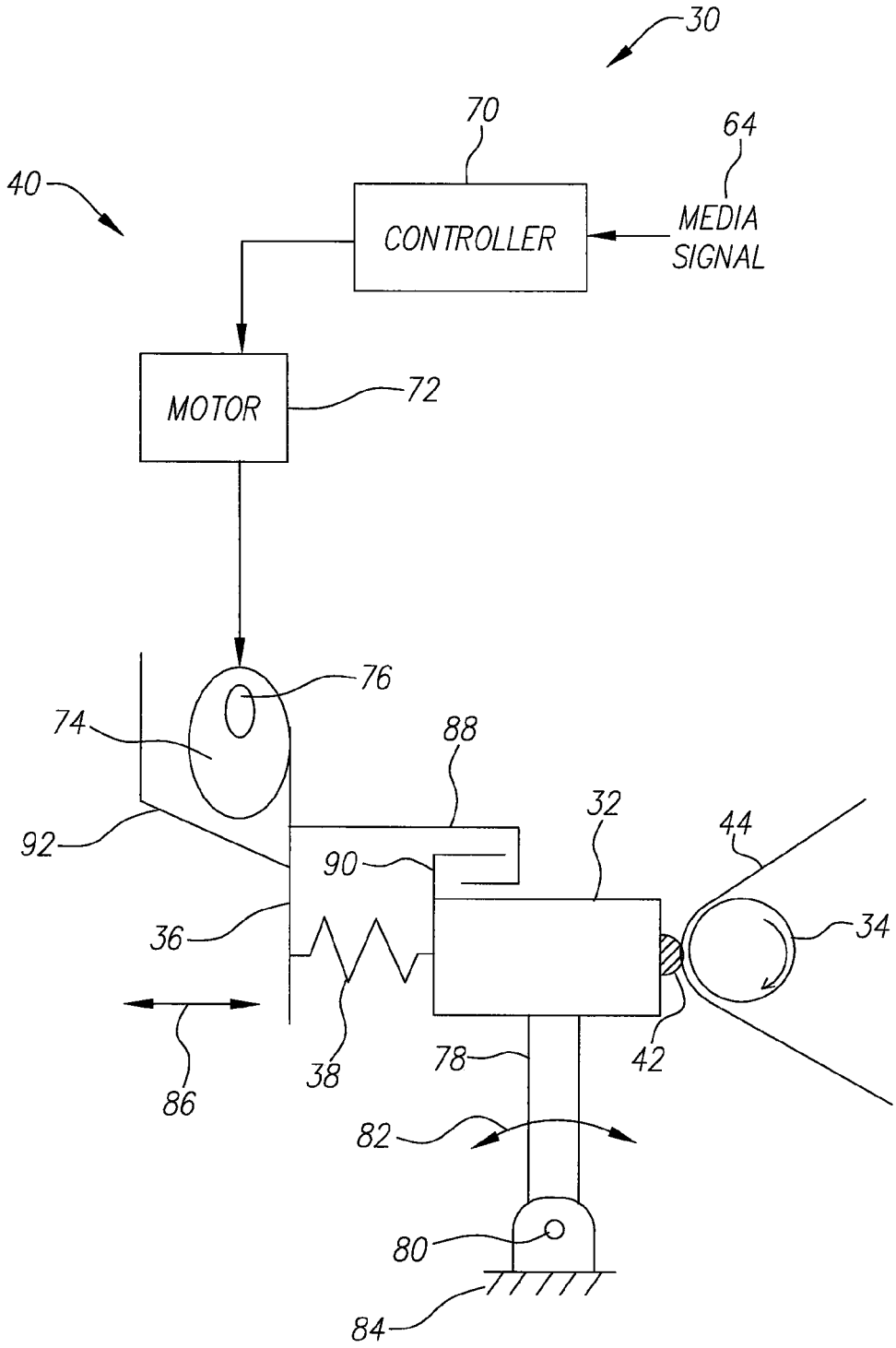
FIG. 2 is a block and schematic diagram illustrating generally one embodiment of a direct thermal printer according to the present invention.

FIG. 2 is a block and schematic diagram illustrating generally one example embodiment of thermal printer 30 in accordance with the present invention. In one embodiment, as illustrated, actuator system 40 includes a controller 70, a motor 72, and a cam 74 fixed-mounted on a rotatable shaft 76. Thermal printhead 32 is coupled to an arm 78 which is rotatable about a pivot element 80 as illustrated by rotational arrow 82. Pivot element 80 is coupled to a housing or fame element of thermal printer 30 as illustrated generally at 84.

In one embodiment, as illustrated, biasing mechanism 38 comprises a spring coupled between thermal printhead 32 and anchor element 36. Spring 38 is compressed so as to bias thermal printhead 32 toward rotatable drum 34 and provide the biasing force to hold the array of thermal elements 32 against the sheet of imaging media 44.

Anchor element 36 is coupled to a housing or other frame element of thermal printer 30 with via a coupling means (e.g. guide posts, guide tracks, etc.), which is not illustrated, that enables movement of anchor element 36 toward and away from rotatable drum 34 and along a path generally tangential to rotatable drum 34 along the line of contact with the array of thermal elements 42, as illustrated by direction arrows 86. A finger element 88 extends from one side anchor element 46 and is configured to slideably interlock with a corresponding finger element 90 extending from thermal printhead 32. An angled flange element 92 extends from the opposite side of anchor element 36. As will be described in greater detail below with respect to FIG. 5, finger elements 88, 90 and angled flange 92 are employed to maintain separation between thermal elements 42 and rotatable drum 34 when media 44 is not present.

Motor 72 of actuating system 40 is coupled to shaft 76 and configured to rotate cam 74 about shaft 76 as directed by controller 70. Based on the width of the sheet of imaging media 44, as represented by media signal 64, controller 70 directs motor 72, via shaft 76, to rotate cam 74 so as to cause anchor element 36 to move toward or away from rotatable drum 34. Causing cam 74 to move anchor element 36 toward rotatable drum 34 further compresses spring 38 and increases the biasing force, and thus increases the head pressure of the array of thermal elements 42 against the sheet of imaging media 44. Similarly, rotating cam element 76 to a position that enables spring 38 to move anchor element away from rotatable drum 34 reduces the compression of spring 38 and, thus, decreases the head pressure of the array of thermal elements 42 against the sheet of imaging media 44.

As an example, in order to maintain the head pressure at a desired level (e.g. 1 kg-f/in.), cam 74 is rotated to a position that moves anchor element 36 toward rotatable drum 34 so as to further compress and increase the biasing force provided by spring 38 when printing to wider sheets of imaging media 44, and is rotated to a position that enables anchor element 36 to move away from rotatable drum 34 so as decompress and decrease the biasing force provided by spring 38 when printing to narrow sheets of imaging media 44.

In one embodiment, as will be described in greater detail below with regard to FIGS. 6 and 7, actuator system 40 includes one or more sensors positioned to monitor and provide indication to controller 70 of the position of cam 74. Based on the indications provided by the sensors, controller 70 is able to determine and control the position of cam 74.

FIGS. 3 through 6 below illustrate an example operation of direct thermal printer 30 as illustrated by FIG. 2. In the illustrative example, direct thermal printer 30 is configured to print images on 10-inch and 14-inch widths of imaging media, and a head pressure of 1 kg-f/in. is desired when printing to both the 10-inch wide media and the 14-inch wide media.

Figure 3:
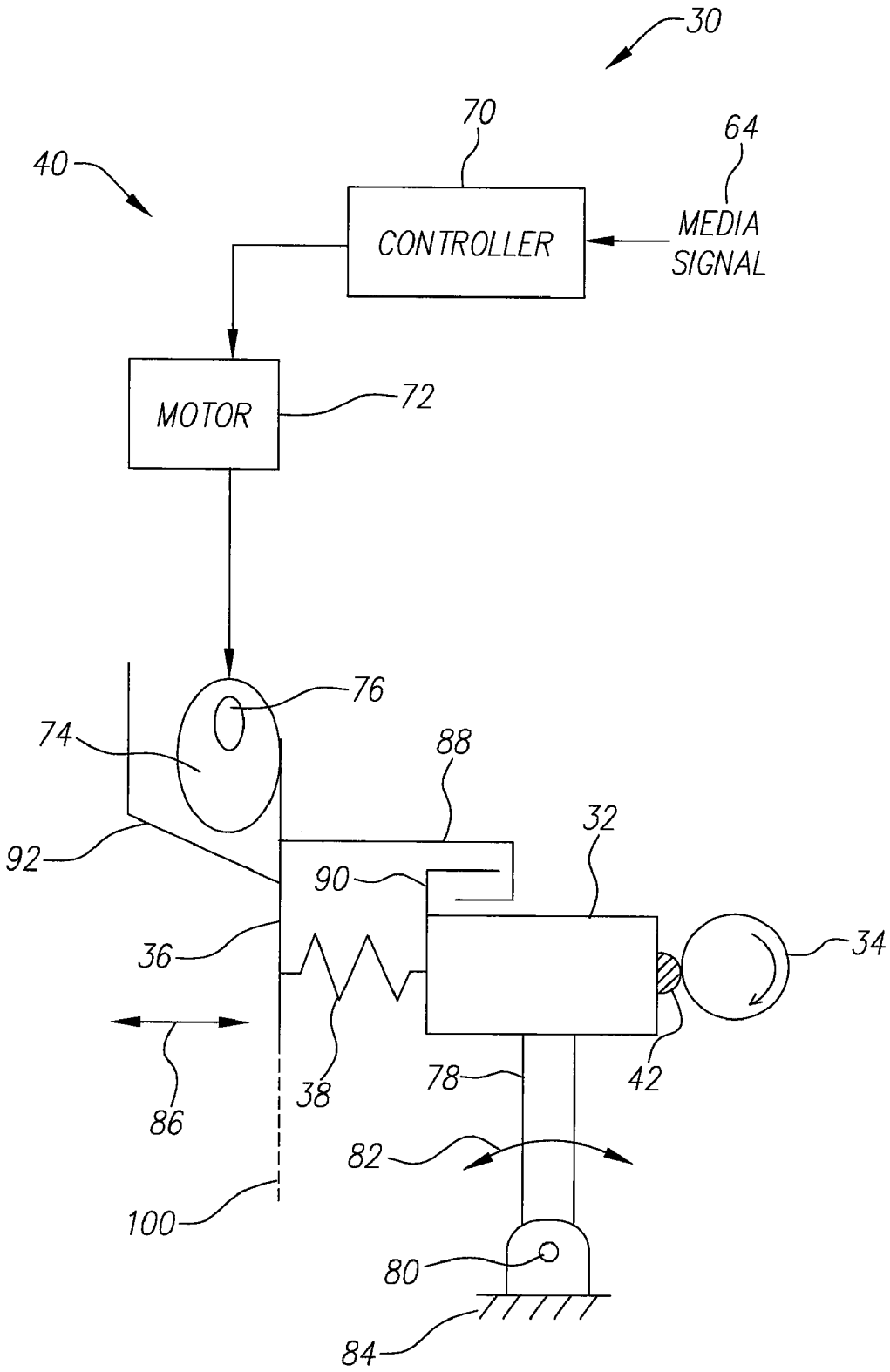
FIG. 3 is a block and schematic diagram illustrating the thermal printer of FIG. 2 in a first contact position.

FIG. 3 illustrates actuator system 40 in a "first contact" position. In the first contact position, controller 70 has caused motor 72 to rotate cam 74, via shaft 76, to a first contact position. In the first contact position, cam 74 has engaged and moved anchor element 36 to a position relative to rotatable drum 34 that causes thermal printhead 32 to rotate about pivot element 80 (clockwise as illustrated) and compresses spring 38 so as to provide a biasing force that holds thermal elements 42 against rotatable drum 34 with a desired minimum head pressure. In one embodiment, for example, the desired minimum head pressure in the first contact position is 0.1 kg-f/in. A corresponding first contact position of anchor element 36 is illustrated by the dashed line at 100. In one embodiment, as will described in greater detail below with regard to FIG. 6, controller 70 determines the position of cam 74 from one or more sensors positioned to monitor the rotation of cam 74.

Figure 4A:
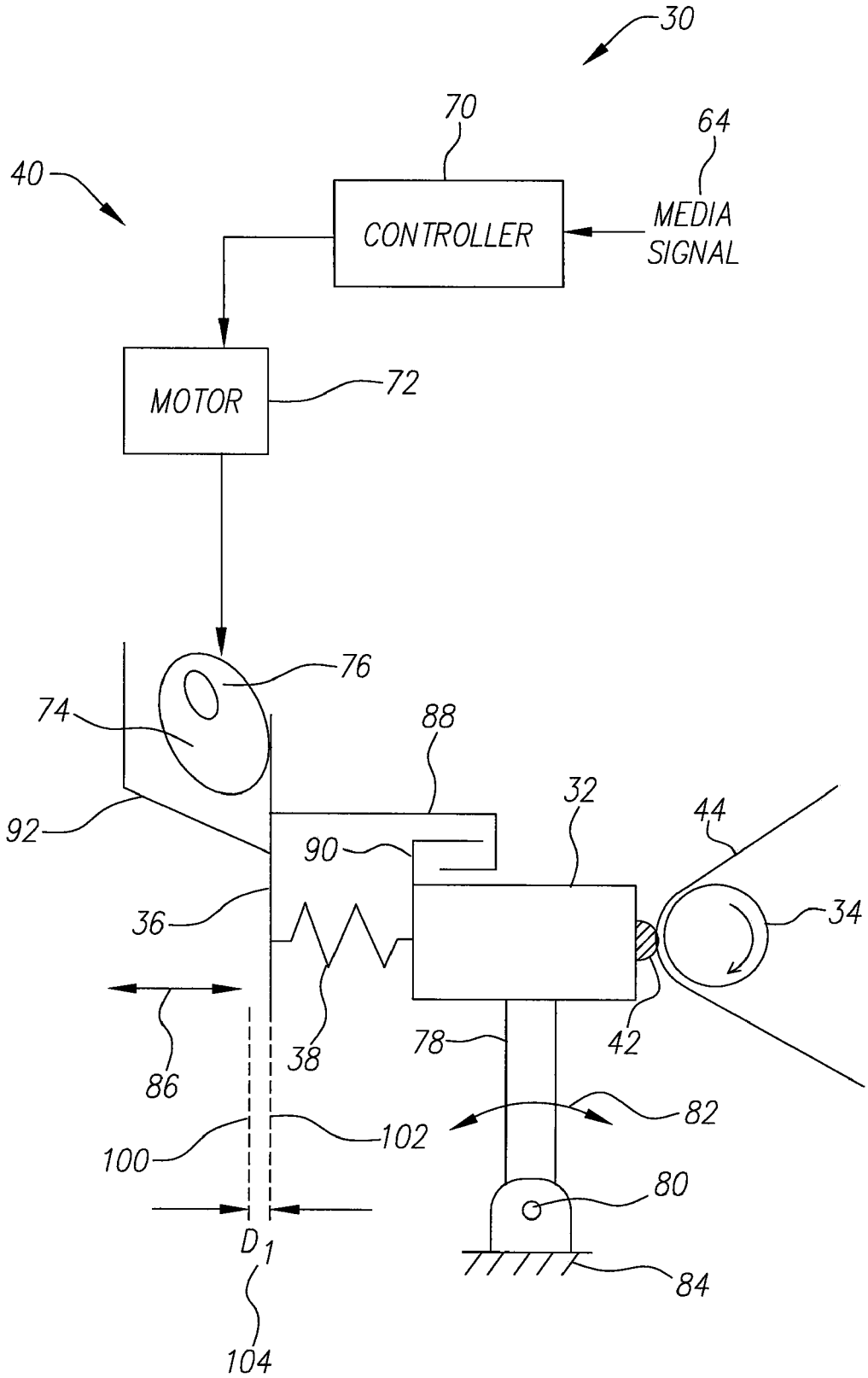
FIG. 4A is a block and schematic diagram illustrating the thermal printer of FIG. 2 in a 10-inch media position.

In one example scenario, as illustrated by FIG. 4A, controller 70 receives media signal 64 indicating that thermal printer 30 is performing a printing operation using 10-inch wide media 44. In response, and prior to the arrival of imaging media 44, causes motor 72 to rotate cam 74, via shaft 76, to a "10-inch media" position. In the 10-inch media position, cam 74 has moved and maintains anchor element 36 at a 10-inch media position, as indicated by the dashed line at 102, which is closer to rotatable drum 34 than first contact position 100 by a distance D1 as indicated at 104.

In the 10-inch media position, spring 38 is compressed so as to provide a biasing force that holds thermal elements 42 against 10-inch media 44 with a desired head pressure. In the illustrative example, a head pressure of 1 kg-f/inch is desired. As such, in the illustrative example, when anchor element 36 is in 10-inch position 102, spring 38 is compressed so as to provide a biasing force substantially equal to 10 kg-f to hold thermal printhead 32 against imaging media 44.

Figure 4B:
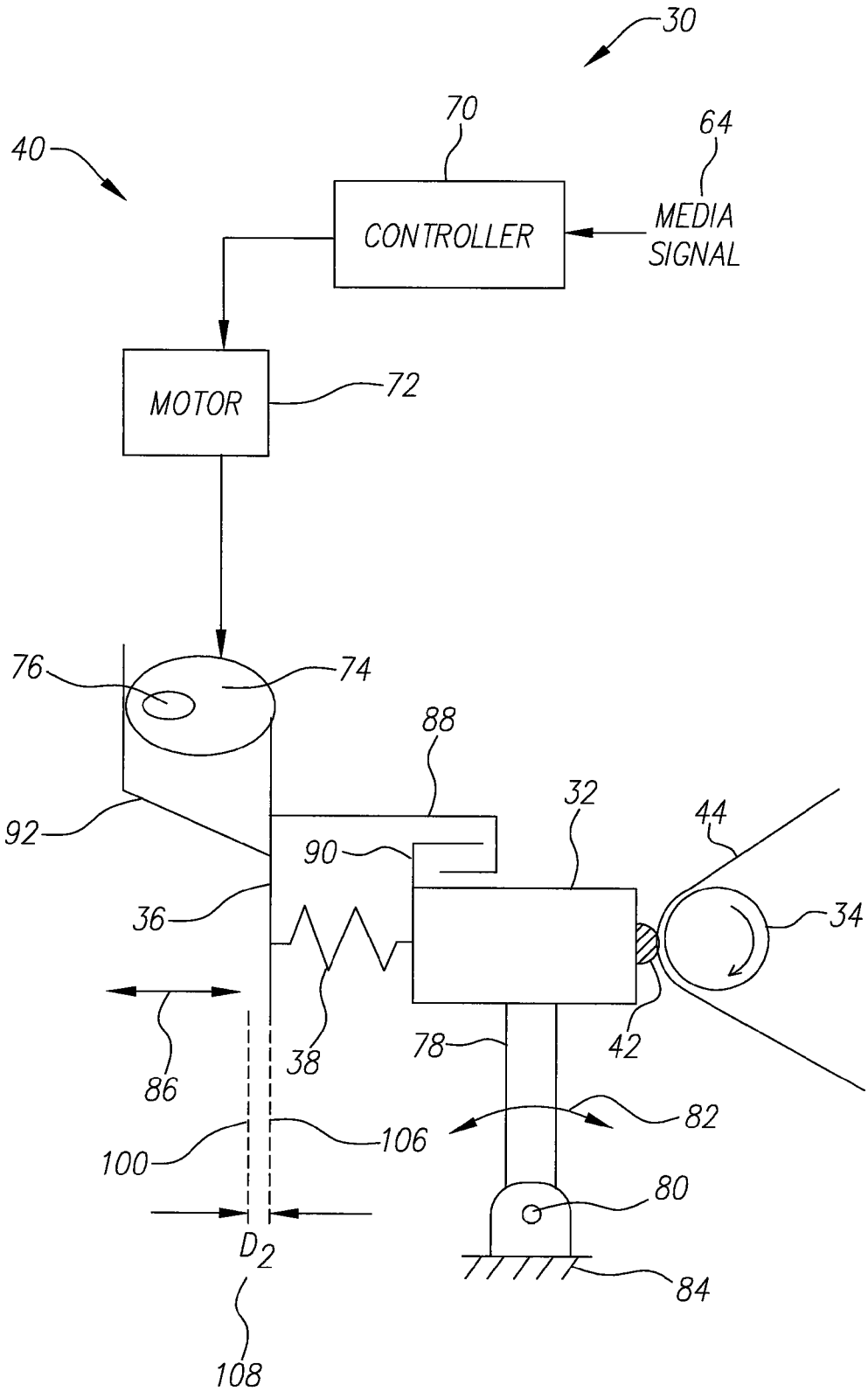
FIG. 4B is a block and schematic diagram illustrating the thermal printer of FIG. 2 in a 14-inch media position.

In one example scenario, as illustrated by FIG. 4B, controller 70 receives media signal 64 indicating that thermal printer 30 is performing a printing operation using 14-inch wide media 44. In response, and prior to the arrival of imaging media 44, causes motor 72 to rotate cam 74, via shaft 76, to a "14-inch media" position. In the 14-inch media position, cam 74 has moved and maintains anchor element 36 at a 14-inch media position, as indicated by the dashed line at 106, which is closer to rotatable drum 34 than first contact position 100 by a distance D2 as indicated at 108.

In the 14-inch media position, spring 38 is compressed so as to provide a biasing force that holds thermal elements 42 against 14-inch media 44 with a desired head pressure. In the illustrative example, a head pressure of 1 kg-f/inch is desired. As such, in the illustrative example, when anchor element 36 is in 14-inch position 102, spring 38 is compressed so as to provide a biasing force substantially equal to 14 kg-f to hold thermal printhead 32 against imaging media 44.

Figure 5:
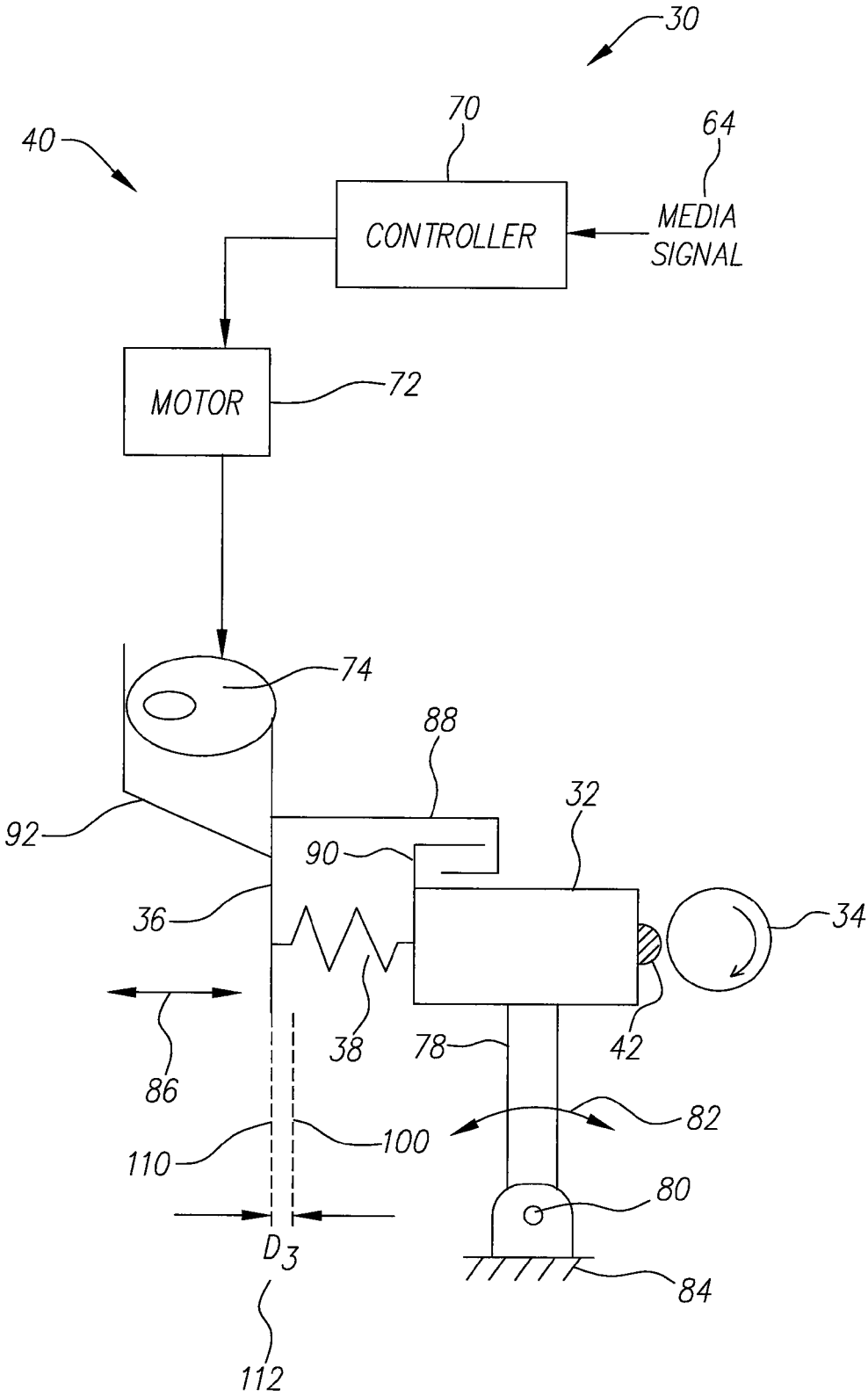
FIG. 5 is a block and schematic diagram illustrating the thermal printer of FIG. 2 in an open position.

FIG. 5 illustrates actuator system 40 in an "open" position. In the open position, controller 70 has caused motor 72 to rotate cam 74, via shaft 76, to an open position. In the open position, cam 74 has engaged angled flange 92 and moved anchor element 36 away from rotatable drum 34 such that finger element 88 has engaged finger element 90 and caused thermal printhead 32 to rotate (counter-clockwise as illustrated) about pivot element 80 so as to separate the array of thermal elements 42 from contact rotatable drum 34. Controller 70 directs cam 74 to the open position when imaging media 44 is not present (e.g. when thermal printer 30 is not in use) to reduce potential damage to the surface of rotatable drum 34 (i.e. indentations) resulting from prolonged contact with the array of thermal elements 42, especially when drum 34 is stationary.

Although illustrated and described above primarily with regard to printing to 10-inch and 14-inch widths of imaging media and maintaining a head pressure of 1 kg-f/inch, thermal printer 30 according to the present invention can be readily adapted for printing to any number of widths of imaging media and for providing and maintaining a head pressure at any number of desired head pressure levels. For example, thermal printer 30 can be adapted for printing to any number of conventional widths of imaging media, such as an 8-inch media width, and to maintain a head pressure within a range of head pressure levels, such as in a range from 0.5 to 1.1 kg-f/inch.

Figure 6:
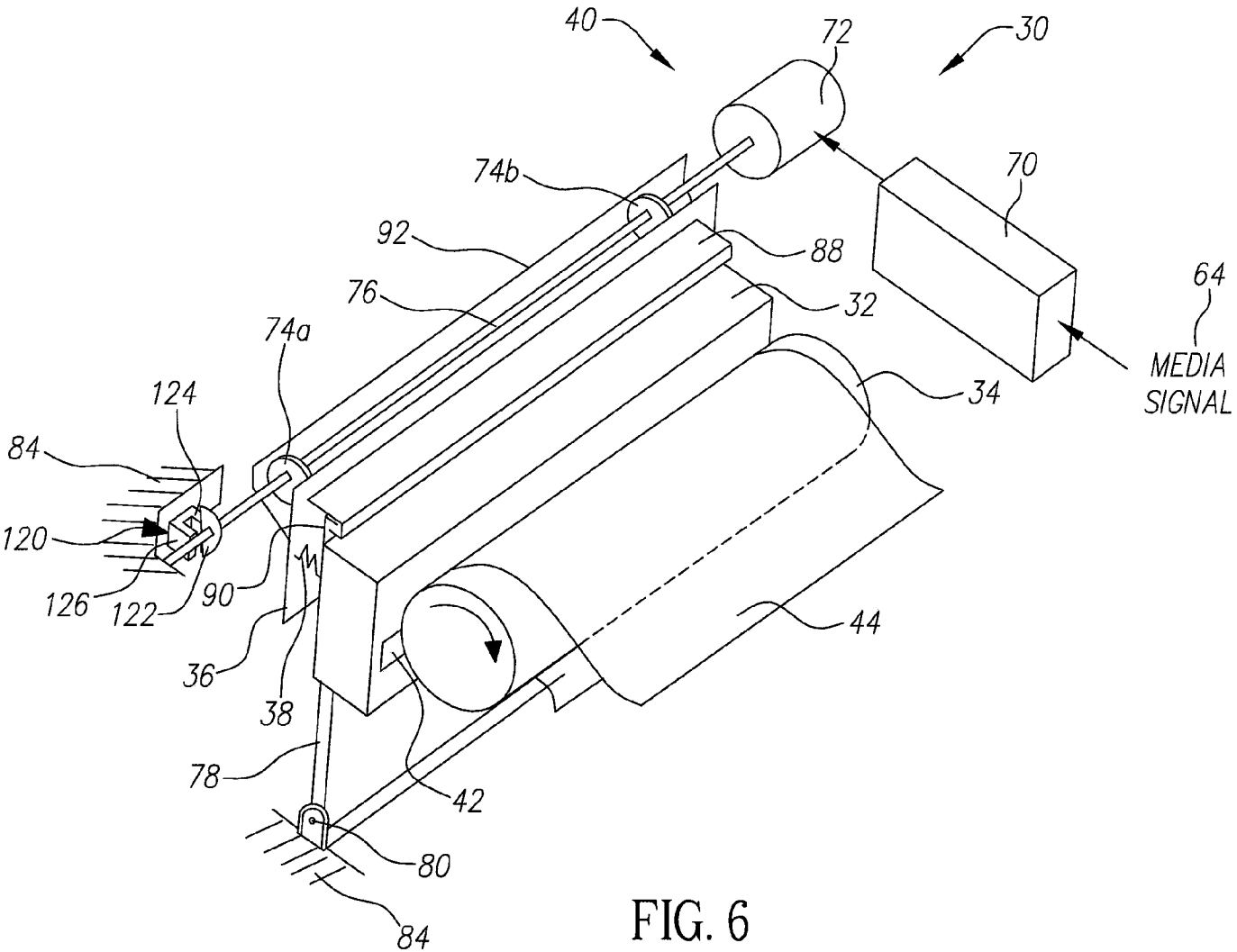
FIG. 6 is a perspective view illustrating generally one embodiment of the direct thermal printer of FIG. 2.

FIG. 6 is an isometric view illustrating generally one embodiment of thermal printer 30 as illustrated by FIG. 2. In one embodiment, cam 74 comprises a pair of cams 74*a*, 74*b* which are fix-mounted to shaft 76 proximate to opposite ends of anchor element 36. Cams 74*a*, 74*b* are keyed to shaft 76 so as to be in rotational alignment with one another as shaft 76 is rotated by motor 72. Shaft 76 is rotatably mounted via bearings (not illustrated) proximate to opposite ends at housing 84 and motor 72, with motor 72 also being coupled to a housing or structural element (not shown).

In one embodiment, as illustrated, actuator system 40 further includes a sensor 120 fix-mounted to housing 84 and a flag element 122 fix-mounted to shaft 76 which together monitor the rotations position of cams 74*a*, 74*b*. In one embodiment, sensor 120 comprises a state-change sensor, such as an optical sensor which monitors light transmitted from a light source 124 to a receiver 126 to determine the position of cams 74*a*, 74*b*.

In one embodiment, as illustrated, flag element 122 has an arcuate shape and is positioned to travel between the light source and receiver of optical sensor 120, with a first edge 128 of flag element 122 corresponding to a first position of cams 74*a*, 74*b* (e.g. 14-inch media position, see FIG. 4B) and a second edge 130 of flag element corresponding to a second position of cam elements 74*a*, 74 (e.g. open position, see FIG. 5). In one embodiment, multiple pairs of sensors 120 and flag element 122 are employed by actuator system 40, with each pair monitoring different positions of cams 74*a*, 74*b*. For example, in one embodiment, a first sensor/flag element pair is employed to monitor the open and first media positions, and a second sensor/flag pair is employed to monitor the 10-inch and 14-inch media positions.

Figure 7:
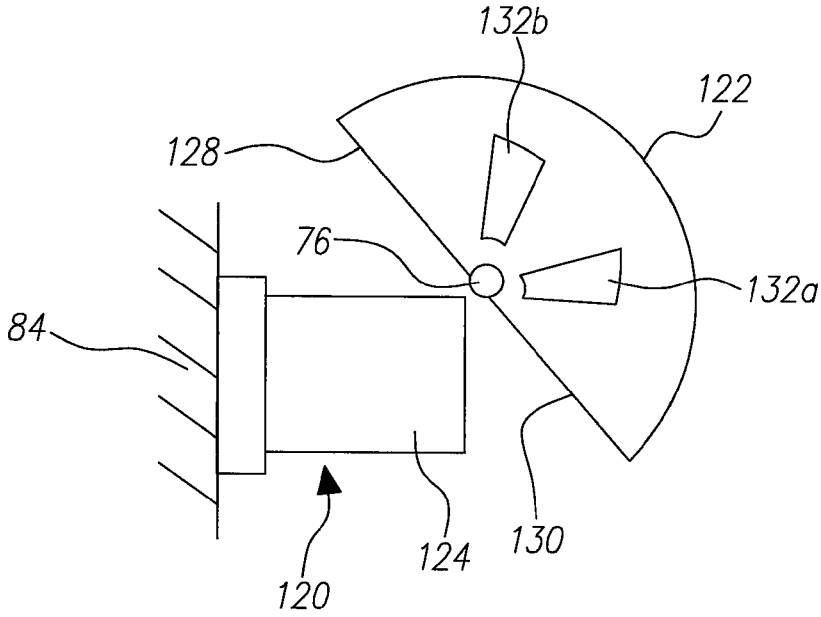
FIG. 7 illustrates generally one embodiment of a flag element for use with the present invention.

In one embodiment, as illustrated by FIG. 7, a single sensor 120 and flag element 122 are employed to monitor multiple positions of cams 74*a*, 74*b*. Flag element 122 includes first and second edges 128, 130, and a plurality of slots or windows 132, illustrated as windows 132*a* and 132*b*, with first and second edges 128, 130 and windows 132*a*, 132*b* each corresponding to a different position of cams 74*a*, 74*b* and thus, to a different position of anchor element 36. For example, in one embodiment, first edge 128 corresponds to open position 110 of anchor element 36, window 132*a* corresponding to first contact position 100, window 132*b* corresponding to 10-inch media position 102, and second edge 130 corresponding to 14-inch media position 106. As shaft 76 is rotated by motor 72, light is alternately blocked and allowed to be transmitted from light source 124 to receiver 126, with each state change corresponding to one of the positions of cams 74*a*, 74*b*, and thus, to a different position of anchor element 76.

In one embodiment, cams 74*a*, 74*b* are configured with a "cam dwell" in each cam position (e.g. open position, first contact position, 10-inch media position, and 14-inch media position). A cam dwell is a section along the circumference of cam having a constant radius from a center of rotation, such as shaft 76. As such, in one embodiment, cams 74*a*, 74*b* have constant radii from shaft 76 along the portions of the circumference contacting anchor element 36 when in the first contact, 10-inch media, and 14-inch media positions, and constant radii from shaft 76 along the portion of the circumference contacting angled flange 92 when in the open position.

By employing cam dwells, cams 74*a*, 74*b* will maintain anchor element 36 at a desired position (e.g. first contact position 100, 10-inch media position 102, 14-inch media position 106, and open position 110) even if driven to a point not exactly at a center point of each cam dwell region by controller 70 and motor 72. As such, in one embodiment, in lieu of employing multiple windows 132 in flag element 122, controller 70 employs simple timing functions to rotate cams 74*a*, 74*b* to positions between the open position and the 14-inch media position.

The invention has been described in detail with particular reference to certain preferred embodiments thereof, but it will be understood that variations and modifications can be effected within the spirit and scope of the invention.

PARTS LIST

30 Thermal Printer
32 Thermal Printhead
34 Rotatable Drum
36 Anchor Element
38 Biasing Mechanism (e.g. Spring)
40 Actuator System

42 Thermal Element Array
44 Image Media
46 Feeder Assembly
48 Removable Cassette
50 Roller Pairs
52 Transport Path
54 Peripheral Rollers
56 Roller Pairs
58 Final Roller Pair
60 Output Tray
62 Media Guide
64 Media Signal
66 Sensor
70 Controller
72 Motor
74 Cam
74*a*, 74*b* Cams
76 Shaft
78 Arm
80 Pivot Element
82 Rotational Arrow
84 Housing
86 Directional Arrow
88 Finger Element
90 Finger Element
92 Angled Flange
100 First Contact Position
102 10-inch Media Position
104 Distance
106 14-inch Media Position
108 Distance
110 Open Position
112 Distance
120 Sensor
122 Flag Element
124 Light Source
126 Receiver
128 First Edge of Flag Element
130 Second Edge of Flag Element
132*a*, 132*b* Flag Element Windows

What is claimed is:

1. An imaging apparatus for thermally recording images on an imaging media, the imaging apparatus comprising:

a printhead having an array of individually energizeable heating elements;

a rotatable drum for conveying an imaging media past the array of heating elements, the imaging media being one of a plurality of widths;

an anchor element moveable within a range of positions;

a biasing mechanism positioned between the printhead and the anchor element and configured to provide a biasing force to hold at least a portion of the array of heating elements against the rotatable drum, wherein a magnitude of the biasing force is based on the position of the anchor element; and an actuator system configured to adjust the position of the anchor element within the range of positions to adjust the magnitude of the biasing force over a range of values so as to maintain a ratio of the magnitude of the biasing force to the width of the imaging media at a same desired value for all widths of the plurality of widths of imaging media.

2. The imaging apparatus of claim 1, wherein the desired value is within a range of values.

3. The imaging apparatus of claim 2, wherein the range of values is from 0.5 to 1.1 kg-f/inch.

4. The imaging apparatus of claim 1, wherein the actuator system comprises:

a shaft rotatable about an axis;

at least one cam fixed-mounted to the shaft a motor operatively coupled to the shaft; and a controller configured to cause the motor to rotate the at least one cam, via the shaft, such that the at least one cam engages and moves the anchor element within the range of positions.

5. The imaging apparatus of claim 4, wherein the controller is configured to cause the motor to rotate the at least one cam, via the shaft, to one of a plurality of angular positions with each angular position causing the anchor element to move to a corresponding position within the range of positions.

6. The imaging apparatus of claim 5, wherein the at least one cam includes a cam dwell at up to all of the angular positions.

7. The imaging apparatus of claim 4, wherein the controller is configured to cause the motor to rotate the at least one cam to one of the plurality of angular positions based on a width of the imaging media.

8. The imaging apparatus of claim 7, wherein a first angular position of the plurality of angular positions corresponds to a 10-inch wide imaging media and a second angular position corresponds to a 14-inch wide imaging media.

9. The imaging apparatus of claim 7, wherein a first angular position of the plurality of angular positions corresponds to an 8-inch wide imaging media and a second angular position corresponds to a 14-inch wide imaging media.

10. A thermal printer configured to print to multiple widths of imaging media, the thermal printer comprising:

a printhead;

a rotatable drum for conveying an imaging media past the printhead;

an anchor element moveable within a range of positions;

a spring positioned between the printhead and the anchor element and configured to provide a biasing force to bias the printhead toward the rotatable drum, wherein the biasing force is based on the position of the anchor element; and an actuator system configured to adjust the position of the anchor element based on the width of the imaging media to adjust the biasing force so as to maintain a ratio of a magnitude of the biasing force to a width of the imaging media at a same desired value for all widths of a plurality of widths of imaging media.

11. The imaging apparatus of claim 10, wherein the actuator system comprises:

at least one cam rotatable about an axis;

a controller configured to cause the at least one cam to rotate about the axis such that the at least one cam engages and moves the anchor element within the range of positions.

12. The imaging apparatus of claim 11, wherein the controller is configured to rotate the at least one cam between a plurality of angular positions, each angular position corresponding to a different position of the anchor element.

13. The imaging apparatus of claim 12, further including at least one sensor configured to provide an indication of the angular position of the at least one cam.

14. A method of operating a thermal printer configured to print to multiple widths of imaging media, the method comprising:

conveying an imaging media past a printhead with a rotatable drum;

providing a biasing force to bias the printhead against the rotatable drum;

adjusting the biasing force based on a width of the imaging media so as to maintain a ratio of a magnitude of the biasing force to a width of the imaging media at a same desired value for all widths of a plurality of widths of imaging media.

15. The method of claim 14, wherein the desired value is within a range of values from 0.5 to 1.1 kg-f/inch.

16. The method of claim 14, wherein adjusting the biasing force includes adjusting an angular position of at least one cam about an axis between a plurality of angular positions, wherein each angular corresponds to a different biasing force.

17. The method of claim 16, including providing at least one sensor to monitor and provide indication of the angular position of the at least one cam.

* * * * *